United States Patent [19]

Parks, Jr.

[11] 4,444,404

[45] Apr. 24, 1984

[54] VARIABLE BORE RAM PACKING ELEMENT AND BLOWOUT PREVENTER

[75] Inventor: Glenn C. Parks, Jr., Shawnee, Okla.

[73] Assignee: Hydril Company, Los Angeles, Calif.

[21] Appl. No.: 435,346

[22] Filed: Oct. 19, 1982

[51] Int. Cl.[3] ..... F16J 15/00; B65D 53/00; E21B 33/06

[52] U.S. Cl. ..... 277/235 R; 251/1 B; 277/127

[58] Field of Search ..... 277/127, 126, 129; 251/1 R, 1 A, 1 B

[56] References Cited

U.S. PATENT DOCUMENTS

| | | | |
|---|---|---|---|
| 3,915,424 | 10/1975 | Le Rouax | 277/127 |
| 4,098,516 | 7/1978 | Murman | 277/235 R |
| 4,229,012 | 10/1980 | Williams | 277/127 |
| 4,339,107 | 7/1982 | Schroder | 277/235 R |
| 4,358,085 | 11/1982 | Regan et al. | 277/235 R |

*Primary Examiner*—Robert I. Smith
*Attorney, Agent, or Firm*—Dodge & Bush

[57] ABSTRACT

A blowout preventer and a seal are disclosed for sealing about pipes or other objects in a well bore. The seal element is a semi-circular section of resilient compressible material having a semi-circular inner surface to engage the pipe and embedded radially disposed support elements having anti-extrusion members which serve in combination with overlapping ram block members to prevent extrusion of the resilient material from the top and bottom of the seal. The top and bottom anti-extrusion members are stair stepped and have interlocking fingers and recesses and are adapted to slide radially and circumferentially with an adjacent anti-extrusion member element as the elements move toward or away from the pipe in the well bore. Flanges on the seal element are provided with top and bottom plates each of which overlaps at least one support element.

14 Claims, 5 Drawing Figures

VARIABLE BORE RAM PACKING ELEMENT AND BLOWOUT PREVENTER

BACKGROUND OF THE INVENTION

1. Field of the Invention

The invention relates generally to blowout preventers forming a part of well drilling equipment as used for example in the drilling of bore holes for oil and gas. More particularly this invention relates to a sealing or packing element for a ram-type blowout preventer where the seal element is compressed about a pipe or other object in the bore hole and where the element may accommodate a range of pipe diameters.

2. Description of the Prior Art

In the past, ram-type blowout preventers were provided in stacks such that each individual ram could effectively seal about a different size of pipe or other object extending through the preventer that might be used during the drilling operation. As a result, it had been normal practice to keep several sets of ram blowout preventers on hand and to change the ram size each time the pipe size was changed during the drilling operation. This changing of the ram and the providing of the various ram sizes was inconvenient, expensive and time-consuming. If the blowout preventer stack were relatively inaccessible as in offshore drilling, it became necessary to include several blowout preventers in the stack so that several different pipe sizes used in the drilling of the well could be properly sealed.

U.S. Pat. No. 4,229,012 describes the technological history as presented in issued U.S. patents of prior attempts to provide ram-type blowout preventers having variable bore sealing capability. That patent discusses the difficulties encountered in the prior attempts and discloses a ram blowout preventer with a packer element of a deformable material having reinforcing elements including top and bottom flanges connected by a rib and embedded in the packer or sealing element to reinforce the assembly and prevent longitudinal extrusion of the deformable material under high pressures. Side sealing elements at each side of the packer recesses are disclosed which provide a reservoir of deformable material during the sealing operation. The steel support elements disclosed in the patent rotate inwardly much like the shutter elements in a camera during a packer or ram seal off. It is believed that this movement creates unnecessary degrees of stress in the sealing elements which can potentially create wear for a relatively short life expectancy.

U.S. Pat. No. 4,332,367 represents another attempt at creating a variable ram sealing element by providing a packer with a semi-circular main body and flange sections with embedded support elements having top and bottom plates interconnected by means of a rib or web material. The plates are placed in a semi-circular ring and along the flange sections and are spaced apart from one another to allow movement of the flanges as the packer element is compressed into the bore about a pipe or other object.

There has been described in the technical literature a variable diameter ram with a packer having interlocking "I" beam inserts molded into the rubber. The inserts contain rubber extrusion during seal off between the ram packer and the drill pipe. The nominal or relaxed diameter of the packer is provided intermediate the operating range for which the packer is designed to seal off. During seal off on small diameter drill pipe, the inserts move toward the drill pipe. When a large diameter drill pipe is in the ram bore, the inserts are compressed into the packer by the pipe thus providing automatic adaptation to the pipe size during ram closure and sealing off around the pipe. Under high pressures, the rubber has a tendency to extrude via the channels between the "I" beams thereby limiting the useful life of the packer.

It is an object of this invention to provide an improved packer assembly for a ram blowout preventer having a nominal diameter intermediate the operating range for pipes about which the packer element will seal for automatic adaptation to the pipe size that is easy to manufacture and reliable in operation.

It is a further object of this invention to provide a variable ram packer which prevents longitudinal extrusion of the resilient sealing material under high pressure conditions.

It is a still further object of this invention to provide a variable ram packer or seal element having support elements which are of simple design and are relatively inexpensive to manufacture.

SUMMARY OF THE INVENTION

The invention relates to a blowout preventer and a seal or packing element for use therein for sealing about pipes or other objects in a well bore. The seal element is a semi-circular section of resilient compressible material such as rubber having a semi-circular intersurface to engage the pipe. Embedded therein are radially disposed support elements which serve as anti-extrusion elements on the top and bottom of the seal. Flanges on the seal element, likewise of resilient compressible material, are provided with top and bottom plates each of which overlaps at least one element support section.

Each support element provided in the packing or seal element has a pair of essentially parallel anti-extrusion members inter-connected by an integral rib. Each parallel anti-extrusion member has an innermost end adapted for engagement with a pipe or other object in the well bore and has a longitudinal stair stepped configuration which adaptes it to slidably engage adjacently disposed anti-extrusion members. Each parallel anti-extrusion member has an interlocking recess on one side of its outermost end and an interlocking finger on the other side of its outermost end where the interlocking finger is adapted to slidably interfit with the interlocking recess on an adjacently disposed anti-extrusion member.

The rib of the support element is attached between the topmost step of the lower parallel anti-extrusion member and the lower-most step of the higher parallel anti-extrusion member and extends to the outermost end of the members while being set back from the innermost end of the members.

The seal element is adapted to fit in the space between upper and lower ram block members which overlap the outermost ends of the support elements embedded in the seal element. The overlapping of the ram block members and the flange plates with the seal elements provides a cooperative design to prevent longitudinal extrusion of the resilient material of the sealing element during high pressure pack off conditions.

BRIEF DESCRIPTION OF THE DRAWINGS

In the drawings wherein like numerals indicate like parts and wherein an illustrative embodiment of this invention is shown.

DESCRIPTION OF THE INVENTION

Detailed Description

Figure 1:
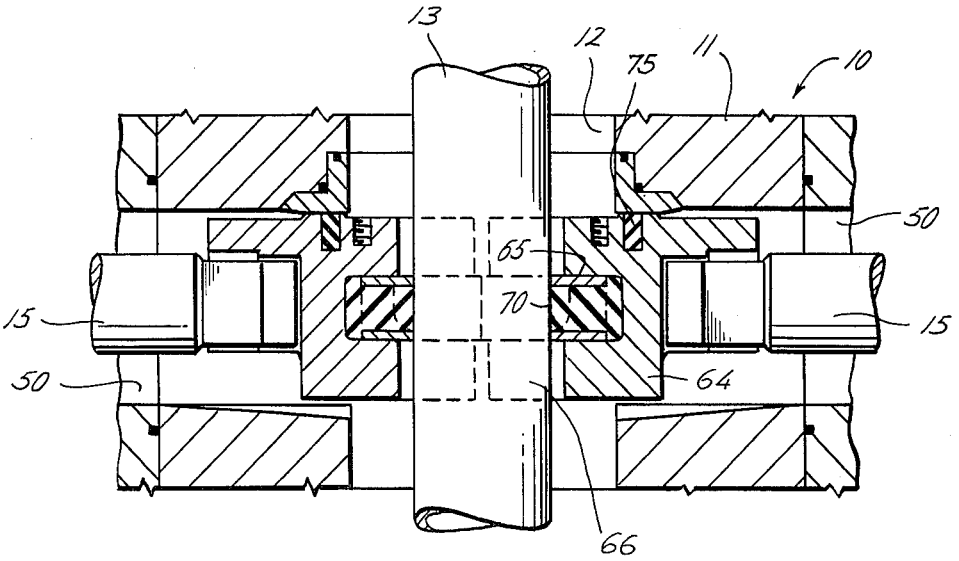
FIG. 1 is a view partly in section and partly in schematic elevation of the blowout preventer according to the invention.

FIG. 1 is a schematic drawing of a ram blowout preventer 10. The blowout preventer includes a housing 11 which has a central longitudinal bore 12 through which a pipe 13 or other object is adapted to extend for well drilling operations. Rods 15 are received in the housing 11 via lateral openings 50. In operation rods 15 urge against a sealing assembly comprising ram block 64 and associated seal or packing element 70. In operation, seal element 70 is urged against a pipe or other object 13 and seals off the annular space between the ram block 64 and the pipe 13. Sealing between the ram block 64 and body 11 is accomplished through conventional elements thereby providing a seal between pipe 13 and bore 12.

Figure 2:
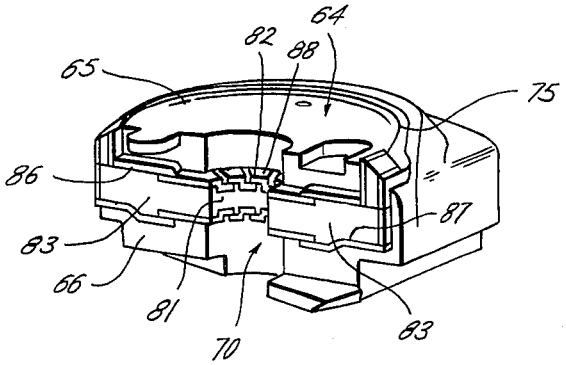
FIG. 2 shows a seal element assembly in a perspective drawing.

FIG. 2 shows in perspective ram block 64 and seal element 70 according to the invention. A seal 75 is advantageously disposed in an annular groove in the upper ram block member 65 in a conventional manner. Seal element 70 according to the invention has a semi-circular section 80 (shown in detail in FIG. 5) of a resilient compressible material such as rubber and has an inner surface 81 adapted to engage a pipe or the like in the well bore. A plurality of radially disposed support elements 82 are embedded in the resilient material. Flange areas 83 extend from the semi-circular central portion of the seal element 70. Flange plates 86 and 87 are provided on the top and bottom sides of flange areas 83.

Seal element 70 fits within the longitudinal space between upper ram block member 65 and lower ram block member 66. As will be explained in more detail below, the support elements 82 of seal element 70 move radially away from or toward the pipe 13 in the longitudinal bore 12 of the annular ram depending on whether or not a pipe is of a diameter greater than or less than the relaxed diameter of the sealing element. The upper and lower ram block members 65 and 66 are constructed to overlap the outermost ends of the embedded support elements 82 of seal element 70 where the support elements 82 are fully extended radially toward the smallest diameter pipe for which the seal element is designed to seal against. The purpose of the ram block members overlapping the outermost ends of the support elements is to aid, in cooperative combination with the design of the support elements, to prevent longitudinal extrusion of the resilient material of the seal element during high pressure pack off conditions. The discussion of the cooperation among the seal element 70, its support members 82, and the ram block members 65, 66 to prevent longitudinal extrusion of resilient material will be deferred until the design of the support members is more fully discussed.

Figure 3:
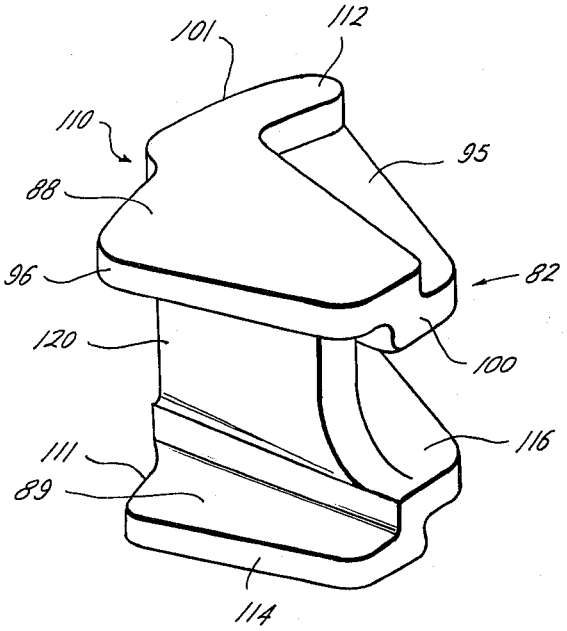
FIG. 3 shows the anti-extrusion element according to the invention in a perspective view.

FIG. 3 shows in more detail the support elements 82 which are embedded in the central part of seal element 70. The support elements 82 have top and bottom anti-extrusion members 88 and 89, each of which is constructed in a stair step configuration. Upper anti-extrusion member 88 has steps 95 and 96 whereby an upper step of an adjacent anti-extrusion member will slidably engage the lower step 95 of anti-extrusion member 88. End 100 of support member 82 is adapted to face toward the inner surface of seal element 70 while outer surface 101 faces radially away from the inner surface and is embedded in the resilient material of semi-circular section 80 (shown in FIG. 5).

The lower anti-extrusion member 89 of support member 82 is likewise constructed in a stair step configuration having a lower step 114 and an upper step 116 whereby the lower step 114 slidably engages the bottom of an upper step 116 of an adjacent anti-extrusion member.

Advantageously the upper anti-extrusion member 88 has on its outermost end 101 a recess 110 on one side and a finger 112 on the other side. Lower anti-extrusion member 89 is a mirror image of upper anti-extrusion member 88. Thus lower anti-extrusion member 89 has a rear recess 111 on the outermost side of lower step 114 and a finger (not illustrated) extending on the plane of the lower step 114 across the upper step 116. When support members 82 are adjacent one another, finger 112 of the upper anti-extrusion member slidably fits with the recess 110 of the adjacent anti-extrusion member and likewise the finger of the lower anti-extrusion member slidably fits with recess 111 of the adjacent lower anti-extrusion member.

Figure 4:
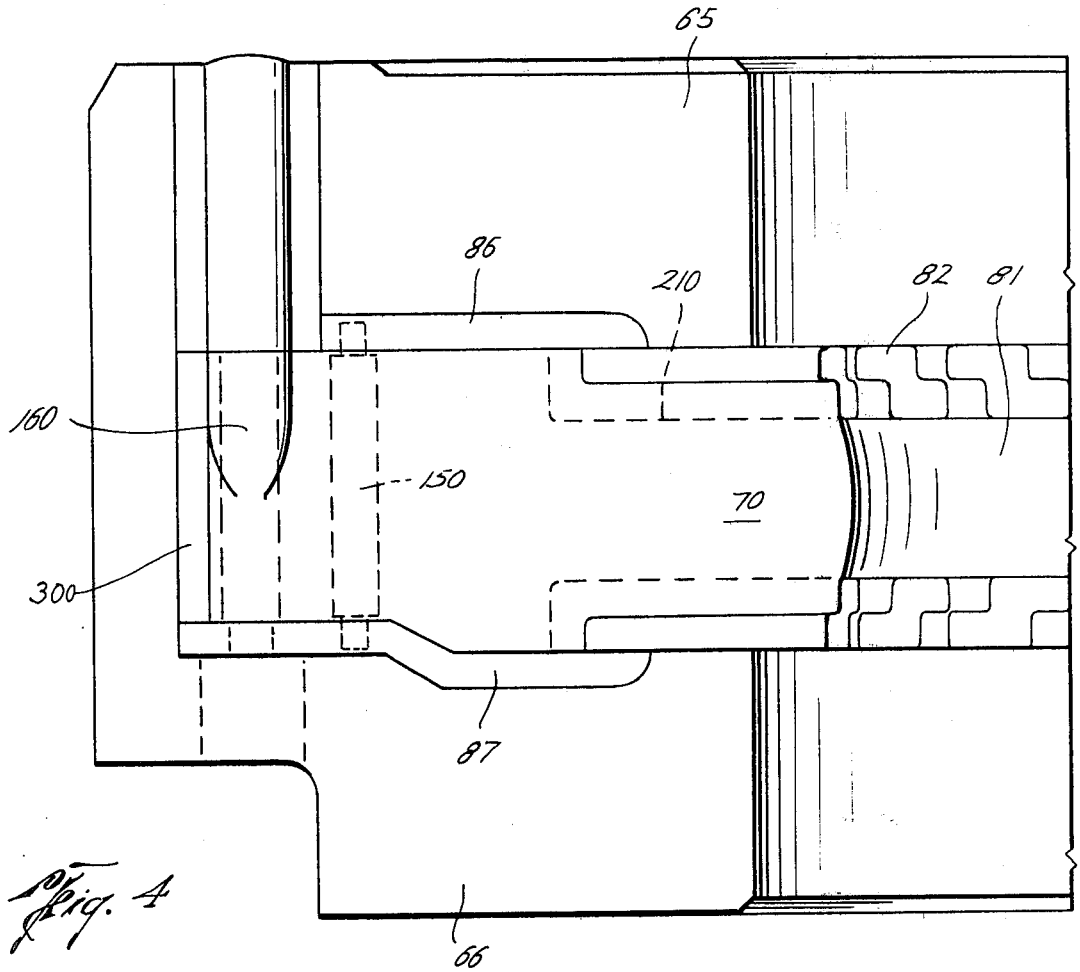
FIG. 4 shows a partial frontal view of the seal element and the ram block according to the invention.
Figure 5:
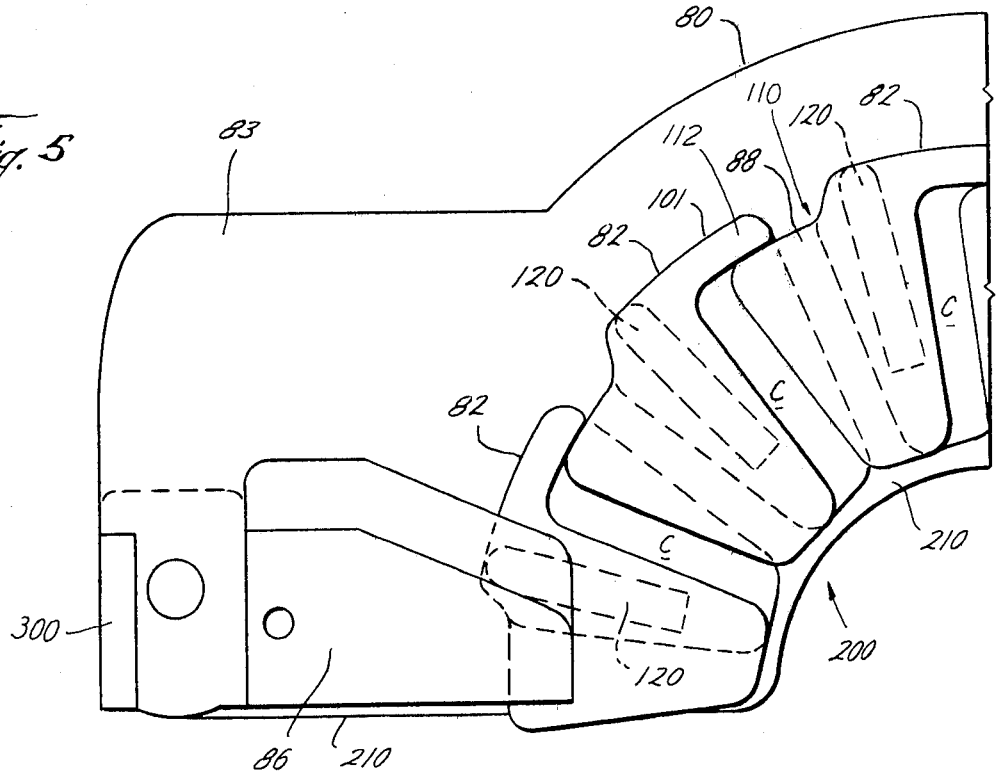
FIG. 5 shows a partial top view of the seal element according to the invention.

Rib 120 connects the two parallel anti-extrusion members 88 and 89. The outermost end of rib 120 extends to the outermost end of surface 101. The innermost end of the rib is set back from the innermost end 100 of the two parallel anti-extrusion members 88 and 89. As will be seen more clearly below where FIGS. 4 and 5 are discussed, resilient material such as rubber is prevented from being extruded above anti-extrusion member 88 by means of interlocking finger/recess 112/110 and ram block 65 which extends in an overlapping manner over a portion of the anti-extrusion members. Likewise, resilient material is prevented from being extruded below anti-extrusion member 89 by means of interlocking finger and recess 111 and ram block member 66 which extends in a overlapping manner over a portion of the anti-extrusion member. Thus, resilient material is confined in the inner seal area when sealing against pipe or other objects in the bore hole.

FIG. 4 is a partial front view of a ram and half of a semi-circular opening of seal element 70 and shows resilient material of sealing surface 81 and support elements 82 embedded therein. Ram block members 65, 66 are shown above and below the seal element 70. Flange plates 86 and 87 are shown overlapping the support element 82 which is the first in the radial series of elements around the semi-circular opening 200. Flange plates 86,87 are retained by means of a pin 150, the heads of which extend into the plates 86 and 87. Advantageously, plates 86 and 87 are also embedded within rubber or resilient material of flange 83. Plates 86 and 87 are also provided to overlap support element 82 which is the last in the radial series of elements around the semi-circular opening 200 (not shown in FIG. 4). Also shown in FIG. 4 is a hole 160 for receiving securing rods associated with seal 75 shown in FIGS. 1 and 2.

Conventional end plates 300 are provided as shown in FIGS. 4 and 5.

FIG. 5 shows a partial top view of seal element 70 and shows the placement of support elements 82 adjacent to one another radially about opening 200. Semi-circular section 80 and flange areas 83 provide a source of resilient material for channeling between the ribs 120 of adjacent support elements and between upper and lower anti-extrusion members 88,89 of adjacently disposed support elements. Advantageously, finger 112 fitting with recess 110 of the top anti-extrusion member (and like fingers and recesses for the lower anti-extrusion member) prevents the rubber or resilient material of the seal element 70 from extruding radially into the spaces "C" (top and bottom) between adjacent anti-extrusion members.

The stair steps of members 88 and 95 prevent longitudinal extrusion of the resilient material of seal element 70 into spaces "C". Spaces "C" are variable in area: small when the support elements move radially inward to meet small diameter pipe; large when support elements move radially outward when large diameter pipe is in the borehole. Ram block members 65 and 66 and flange plates 86 and 87 fit above and below over the outermost ends 101 of the anti-extrusion members as seen in FIGS. 2 and 4. Thus under high force urging of the ram on the seal element, the rubber or other resilient material is prevented from extruding above, or below the seal element by the cooperation of overlapping of the stair steps of the anti-extrusion members, the overlapping of the ram blocks and flange plates with the anti-extrusion members and the interlocking of the fingers/recesses of the anti-extrusion members.

Radial extrusion of rubber into the upper and lower spaces between overlapping steps of the anti-extrusion members is prevented by the finger-recess interlocking feature of the invention. Longitudinal extrusion of rubber from the semi-circular section 80 and flange section 83 of seal element 70 is prevented because of the placement of ram block members 65 and 66 and flange plates 86 and 87 over the outermost ends of anti-extrusion elements 82. Longitudinal extrusion of rubber between anti-extrusion members 88,89 is prevented by means of the slidable overlapping steps of adjacent members.

Advantageously, a ridge 210 of resilient material extends along the flanges and around the semi-circular perimeter of the sealing element opening 200.

OPERATION OF THE INVENTION

As the seal element 70 is in place about a pipe of smaller diameter than the nominal or "relaxed" diameter of seal element 70 and is required to seal off the annulus between the pipe and the bore hole opening, the ram block 64 is urged radially by rod 15 causing seal element 70 to be urged radially toward the pipe. When this occurs, support elements 82 move radially inward and slidably engage circumferentially on the stair step constructions as shown in FIG. 5. On the other hand, when the packer meets a pipe or other object of a diameter larger than the nominal diameter of its opening, the support elements 82 are urged radially outwardly into the packing resilient material.

When seal off force is imparted by rod 15 to ram block 64, the packer or seal element 70 is urged against the pipe. The innermost ends 100 of the anti-extrusion members engage the pipe while the resilient material controlled between the anti-extrusion members is forced against the pipe thereby sealing the ram block to the pipe.

Resilient material is controlled against longitudinal extrusion by the combination of overlapping stair steps 95,96 and 89,116 of anti-extrusion members 88 and 89, flange plates 86 and 87 overlapping the outermost ends of anti-extrusion members 88 and 89 which are disposed on the opposing ends of the semi-circular sealing element, finger/recess construction of the top and bottom anti-extrusion elements, and the overlapping ram block top member 65 and bottom ram block member 66 over the outermost ends of anti-extrusion elements 82. The resilient material is controlled to move within the interior channels defined between the ribs and between the slidably engaged upper and lower anti-extrusion members. Thus, the resilient material is forced against the pipe and is controlled against longitudinal extrusion along the pipe by the engagement of the innermost surfaces 100 of the anti-extrusion members 82 with the pipe.

From the foregoing, it is apparent there has been provided a packing element for use in a blowout preventer, especially useful in variable diameter ram blowout preventers. Various modifications and alterations in the described structures will be apparent to those skilled in the art of the foregoing description which do not depart from the spirit of the invention. For this reason, these changes are desired to be included in the appended claims. The appended claims recite the only limitations of the present invention and the descriptive manner which is employed for setting forth the present embodiment and is to be interpreted as illustrative and not limitative.

What is claimed is:

1. A seal element adapted for use over a range of operating diameters in a blowout preventer having a ram block with upper and lower ram block members, the seal element comprising, an essentially semicircular section of a resilient, compressible material having an inner surface adapted to engage a pipe or the like in a well bore having a plurality of radially disposed substantially identical rigid support elements embedded in said material, each support element having a pair of essentially parallel stair-stepped anti-extrusion members that are disposed on opposite longitudinal sides of the semi-circular section and that are interconnected by an integral rib, the integral rib being attached between the top-most step of the lower parallel anti-extrusion member and the lower-most step of the higher parallel anti-extrusion member, said rib extending to said outermost end of said members while being set back from the innermost end of said members, the anti-extrusion members having surfaces for overlapping with adjacent anti-extrusion members, the seal element being adapted to fit within the longitudinal space between said upper and lower ram block members of said blowout preventer such that said ram block members overlap the outermost ends of said top and bottom anti-extrusion members when said seal element is operative on the smallest of its operating diameters.

2. The seal element of claim 1 further comprising, radial flange sections of resilient compressible material from diametrically opposed positions on the semi-circular section, each flange section including oppositely disposed rigid plate members, each partially overlapping at least one of the parallel anti-extrusion members.

3. The seal element of claim 2 wherein said rigid plate members are attached to the radial flange members by means of a pin embedded in said flange section with ends extending into said oppositely disposed rigid plate members.

4. The seal element of claim 1 wherein each parallel anti-extrusion member of each support element has an innermost end for engagement with a pipe or other object in a well bore and has a longitudinal stair stepped configuration for slidable engagement with adjacent anti-extrusion members in response to radial urging of said seal element toward or away from a well bore.

5. The seal element of claim 4 wherein each anti-extrusion member has an interlocking recess on one side of the outermost end of said section and an interlocking finger on the other side of the outermost end of said section and is adapted to slidably interfit with the interlocking recess on the adjacent anti-extrusion member.

6. The seal element of claim 1 wherein the nominal diameter of the inner surface section of resilient compressible material is intermediate the range of operating diameters, and wherein in response to radial urging of said seal element to seal against smaller diameter objects, the support elements move radially inward for engagement with a pipe or other object in a well bore, and wherein a pipe or other object in the well bore of a diameter greater than the nominal diameter of the inner surface of the seal element displaces said support elements radially outward and into said compressible material.

7. A ram blowout preventer comprising, a body member having a well bore for the reception of a drill string and having two ram chambers in a plane essentially perpendicular to the well bore, a ram assembly in each of the ram chambers, each assembly including a ram block and a seal element carried by the ram block being movable as a unit in respective chambers essentially perpendicular to the well bore, the seal element being capable of use with a variety of pipes or other objects in a well bore and having, an essentially semi-circular section of a resilient, compressible material having an inner surface adapted to engage a pipe or the like in a well bore having a plurality of radially disposed substantially identical rigid support elements embedded in said material, each support element having a pair of essentially parallel anti-extrusion members that are disposed on opposite longitudinal sides of the semi-circular section and that are interconnected by an integral rib which is attached between the top-most step of the lower parallel anti-extrusion member and the lower-most step of the higher parallel anti-extrusion member, and said rib extends to said outermost end of said sections while being set back from the innermost end of said members, the anti-extrusion members having surfaces for overlapping with adjacent support sections, and radial flange sections of resilient compressible material from diametrically opposed positions on the semi-circular section, each flange section including oppositely disposed rigid plate members, each partially overlapping at least one of the parallel support sections, the upper and lower elements of said ram block overlapping said anti-extrusion member, whereby said resilient material is prevented from longitudinal extrusion on radial urging of said seal element against a pipe or other object in the well bore.

8. The blowout preventer of claim 7 wherein said rigid plate members are attached to the radial flange members by means of a pin embedded in said flange section with ends extending into said oppositely disposed rigid plate members.

9. The blowout preventer of claim 7 wherein each parallel anti-extrusion member of each support element has an innermost end for engagement with a pipe or other object in a well bore and has a longitudinal stair stepped configuration for slidable engagement with adjacent anti-extrusion members in response to radial urging of said seal element toward or away from in a well bore.

10. The blowout preventer of claim 9 wherein each anti-extrusion member has an interlocking recess on one side of the outermost end of said section and an interlocking finger on the other side of the outermost end of said section and is adapted to slidably interfit with the interlocking recess on the adjacent anti-extrusion member.

11. The blowout preventer of claim 7 wherein the nominal diameter of the inner surface section of resilient compressible material is intermediate the range of operating diameters, and wherein in response to radial urging of said seal element to seal against smaller diameter objects, the anti-extrusion members move radially inward for engagement with a pipe or other object in a well bore, wherein a pipe or other object in the well bore of a diameter greater than the nominal diameter of the inner surface of the seal element displaces said anti-extrusion members radially outward and into said compressible material, and wherein said upper and lower ram block members are adapted to overlap the finger/recess portion of the outermost end of said upper and lower anti-extrusion members.

12. A support element adapted for use in a seal element for a blowout preventer comprising, a pair of essentially parallel anti-extrusion members interconnected by an integral rib, the anti-extrusion members having surfaces for overlapping with adjacently disposed similarly constructed sections, each parallel anti-extrusion member having an innermost end adapted for engagement with a pipe or other object in a well bore and having longitudinal stair stepped surfaces adapted for slidable engagement with adjacently disposed anti-extrusion members, each parallel anti-extrusion member having an interlocking recess on one side of its outermost end and an interlocking finger on the other side of its outermost end where the interlocking finger is adapted to slidably interfit with the interlocking recess on an adjacently disposed anti-extrusion member and wherein the integral rib is attached between the top-most step of the lower parallel anti-extrusion member and the lower-most step of the higher parallel anti-extrusion member, and said rib extends to said outermost end of said sections while being set back from the innermost end of said members.

13. For use in a blowout preventer to seal with a pipe or other object in a well bore, a seal element for use over a range of operating diameters, comprising, an essentially semi-circular section of a resilient, compressible material having an inner surface adapted to engage a pipe or the like in a well bore and having, a plurality of radially disposed rigid support elements embedded in said material, each support element having a pair of essentially parallel anti-extrusion members interconnected by an integral rib, the anti-extrusion members having surfaces for overlapping with adjacently disposed similarly constructed members, each parallel anti-extrusion member having an innermost end adapted for engagement with a pipe or other object in a well bore and having longitudinal stair stepped surfaces adapted for slidable engagement with adjacently disposed anti-extrusion members, each parallel anti-extrusion member having an interlocking recess on one side of its outermost end and an interlocking finger on the other side of its outermost end where the interlocking finger is adapted to slidably interfit with the interlocking recess on an adjacently disposed anti-extrusion member, the integral rib being attached between the top-most step of the lower parallel anti-extrusion member and the lower-most step of the higher parallel anti-extrusion member, said rib extending to said outermost end of said members while being set back from the innermost end of said members, radial flange sections of resilient compressible material from diametrically opposed positions on the semi-circular section, each flange section including oppositely disposed rigid plate members, each partially overlapping at least one of the parallel anti-extrusion members, a pin embedded in said flange section with ends extending into said oppositely disposed rigid plate members, wherein the nominal diameter of the inner surface section of resilient compressible material is intermediate the range of operating diameters, and wherein in response to radial urging of said seal element to seal against smaller diameter objects, the support elements move radially inward for engagement with a pipe or other object in a well bore, and wherein a pipe or other object in the well bore of a diameter greater than the nominal diameter of the inner surface of the seal element displaces said support elements radially outward and into said compressible material.

14. A ram blowout preventer comprising, a body member having a well bore for the reception of a drill string and having two ram chambers in a plane essentially perpendicular to the well bore, a ram assembly in each of the ram chambers, each assembly including a ram block and having upper and lower ram block members, and a seal element carried by the ram block, the block and seal element being movable as a unit in respective chambers essentially perpendicular to the well bore, the seal element being capable of use with a variety of diameters of pipes or other objects in a well bore and having, an essentially semi-circular section of a resilient, compressible material having an inner surface adapted to engage a pipe or the like in a well bore and having, a plurality of radially disposed rigid support elements embedded in said material, each support element having a pair of essentially parallel anti-extrusion members interconnected by an integral rib, the anti-extrusion members having surfaces for overlapping with adjacently disposed similarly constructed members, each parallel anti-extrusion member having an innermost end adapted for engagement with a pipe or other object in a well bore and having longitudinal stair stepped surfaces adapted for slidable engagement with adjacently disposed anti-extrusion members, each parallel anti-extrusion member having an interlocking recess on one side of its outermost end and an interlocking finger on the other side of its outermost end where the interlocking finger is adapted to slidably interfit with the interlocking recess on an adjacently disposed anti-extrusion member, the integral rib being attached between the top-most step of the lower parallel anti-extrusion member and the lower-most step of the higher parallel anti-extrusion member, said rib extending to said outermost end of said members while being set back from the innermost end of said members, the upper and lower ram block members being adapted to overlap the finger/recess portion of the outermost ends of said upper and lower anti-extrusion members, radial flange sections of resilient compressible material from diametrically opposed positions on the semi-circular section, each flange section including oppositely disposed rigid plate members, each partially overlapping at least one of the parallel anti-extrusion members, a pin embedded in said flange section with ends extending into said oppositely disposed rigid plate members, and wherein the nominal diameter of the inner surface section of resilient compressible material is intermediate the range of operating diameters, and wherein in response to radial urging of said seal element to seal against smaller diameter objects, the support elements move radially inward for engagement with a pipe or other object in a well bore, wherein a pipe or other object in the well bore of a diameter greater than the nominal diameter of the inner surface of the seal element displaces said support elements radially outward and into said compressible material, and whereby said resilient material is prevented from longitudinal extrusion on radial urging of said seal element against a pipe or other object in the well bore.

* * * * *